United States Patent [19]

Murphy

[11] Patent Number: 4,691,554

[45] **Date of Patent: * Sep. 8, 1987**

[54] DIE TRANSFER SYSTEM

[76] Inventor: William P. Murphy, 1067 Kennesaw Ave., Birmingham, Mich. 48008

[ * ] Notice: The portion of the term of this patent subsequent to Feb. 12, 2002 has been disclaimed.

[21] Appl. No.: 744,028

[22] Filed: Jun. 12, 1985

[51] Int. Cl.[4] ..... B30B 15/02; B21J 13/08

[52] U.S. Cl. ..... 72/448; 72/481; 100/224; 100/918

[58] Field of Search ..... 72/446, 448, 481; 29/465; 100/224, 918, 229 R, 295; 308/6 R

[56] References Cited

U.S. PATENT DOCUMENTS 3,935,811 2/1976 Lenz ..... 72/448

4,498,384 2/1985 Murphy ..... 72/448

*Primary Examiner*—Robert L. Spruill

*Assistant Examiner*—David B. Jones

*Attorney, Agent, or Firm*—Lyman R. Lyon

[57] ABSTRACT

The disclosure relates to an improved die transfer system for a press having bolster with conventional inverted T-slots therein. The system comprises a pair of elongated, parallel vertically movable rails. A plurality of rollers are supported by each rail so as to be movable vertically therewith. An air bag extends longitudinally of each of said T-slots under said rails and is engageable with the bottom thereof. Inflation of the air bags effects elevation of the rails and rollers into engagement with the bottom of the die and elevation of the die relative to the press bolster. The rails have laterally extending flanges that are engageable with complementary shoulders of the T-slots to limit upward movement of the rails and preclude bowing of the rails.

1 Claim, 3 Drawing Figures

FIG. 1.
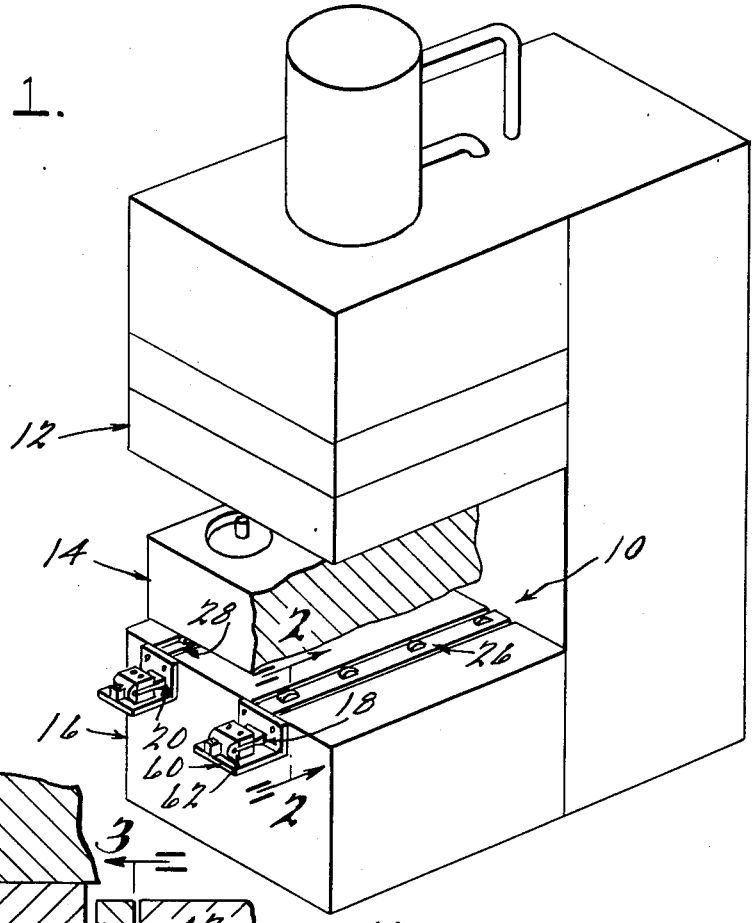
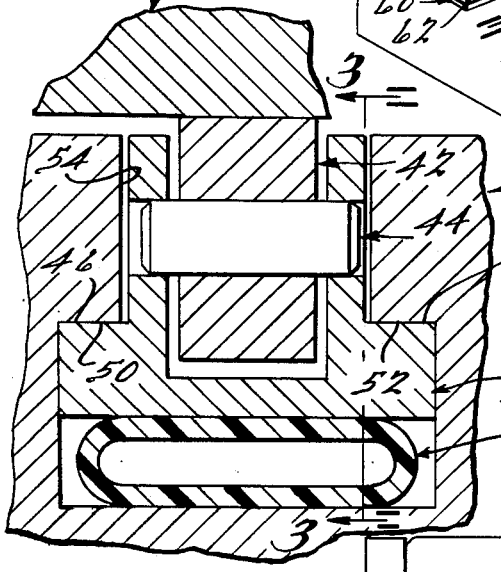
FIG. 2.
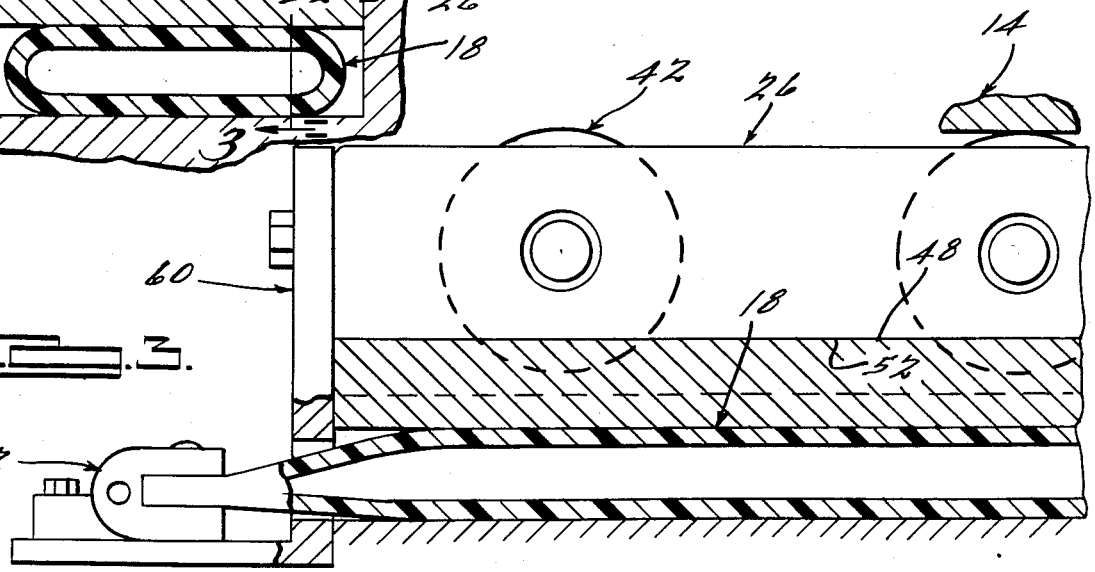
FIG. 3.

DIE TRANSFER SYSTEM

BACKGROUND OF THE INVENTION

Relatively heavy stamping and injection molding dies present a handling problem when such dies are assembled with or removed from the bolster of a press. The problem is complicated by the fact that the press generally has a ram or other superstructure mounted directly over the die support bolster precluding vertical lift of the die or die set by a conventional crane. Movement of a die set laterally with respect to the bolster of such presses has heretofore required modification of the press bolster for the acceptance of relatively complex and fragile transfer systems.

More specifically, while applicant's U.S. Pat. No. 4,498,384 as well as the patents to Yonezawa, U.S. Pat. No. 4,301,673; Long (British) 1,002,355; and Evers (German) 1,128,360 each teach a system for elevating rolls to facilitate movement of an article, the aforesaid patents do not solve the problem of elevating dies relative to the bed of a press by a mechanism that utilizes and is compatible with the existing T-slots in the press bed.

SUMMARY OF THE INVENTION

The die transfer system of the instant invention is rugged and simple in construction. Roller supporting rails are orientated in spaced, parallel relation within the conventional T-slots of the bolster of a press. An air bag is disposed under each rail which, upon inflation effects elevation of the rail. Elevation of each rail is controlled by continuous shoulders defined by the T-slots which positively limit upward movement of the rail and therefore the degree of elevation of the die. Upon elevation, the die is free to move in a direction parallel to the rails.

BRIEF DESCRIPTION OF THE DRAWINGS

FIG. 1 is a perspective view of a press incorporating the die transfer system of the instant invention;

FIG. 2 is a view taken substantially along the line 2—2 of FIG. 1; and

FIG. 3 is a view taken substantially along the line 3—3 of FIG. 2.

DETAILED DESCRIPTION OF THE PREFERRED EMBODIMENT OF THE INVENTION

As seen in FIG. 1 of the drawing, a die transfer system 10, in accordance with a constructed embodiment of the instant invention, is mounted on a heavy duty press 12 to facilitate movement of a die 14 on and off a bolster 16 of the press 12. The transfer system 10 comprises a pair of air bags 18 and 20 which underlie a pair of inverted, T-shaped rails 26 and 28, respectively. The air bags 18 and 20 are adapted to be energized by air at conventional shop pressure, for example, 50–100 lbs. per square inch. Only the air bag 18 and its associated structure will be discussed hereinafter for the purpose of simplicity, it being understood that any desired number of similar air bags may be employed, as required by load requirements.

As best seen in FIG. 2 of the drawing, the rail 26 has a plurality of rolls 42 thereon that are journaled on shafts 44 so as to move with the rail 26 to elevate and support the die 14 for movement upon inflation of the air bag 18.

In accordance with the instant invention, the rail 26 has two spaced, parallel flanges 46 and 48 that are engageable with complementary shoulders 50 and 52, respectively, of a conventional T-slot 54 in the bolster or bed 16 of the press 12 to limit upward movement of the rail 26. Because the flanges 46 and 48 on the rail 26 are coextensive with the shoulders 50 and 52, of the T-slot 54, bowing of the rail 26 is minimized thereby equalizing load on the rollers 42. An end plate 60 is provided at each end of the T-slots 54 to support the combination clamp and intake port 62 of the air bag 18 as well as to preclude movement of the rail 26 longitudinally of the T-slot 54. A similar end plate (not shown) at the opposite end of the intake port 62 also functions as a keeper for the rail 26.

Operation of the die transfer system 10 is best visualized by noting that, in FIGS. 2 and 3, the air bag 18 is in the inflated condition and the rail 26 and each roller 42 thereon is elevated into engagement with the die 14 to effect elevation thereof. Deflation of the air bag 18 results in lowering of the rail 26 to a position wherein the upper surface of each roll 42 is disposed below the lower surface of the die 14 permitting the die 14 to rest upon the press bed 16.

From the foregoing description it should be apparent that the die transfer system of the instant invention is relatively simple, rugged in construction, and utilizes the existing T-slots of a press. It is operable to effect elevation of relatively heavy die sets so as to condition them for lateral movement on the rolls of the transfer system.

The system is practical for die sets weighing from 1–20 tons. In a working embodiment, the lift rails 26 and 28 have 1000# rollers on three-inch centers. Lift is accomplished by air bags rated at 500 psi. When the air bags 18 and 20 are pressurized, the rails 26 and 28 lift 3/16 inch to raise the rollers 42 $\frac{1}{8}$ inch above the top face of the bolster 16. Lift capacity is approximately 1200# per running foot, depending on psi input. The coefficient of rolling friction on the crowned rollers is 0.010, so that a 10,000# die set requires only 100# push force to effect lateral movement thereof.

To determine rail length for a given application, rail length in inches is multiplied by 1.275×air pressure in psi which equals lift force of rail. For example, a 48-inch long rail×1.275×90 psi air=5508# lift force. If the heaviest die set for a given press is 20,000#, it would require four rails resulting in a total of 22,032# lift.

Air consumption is approximately 1/80 cu. ft. per running foot of rail. Specifically, 0.0145 cu. ft. at 100 psi, and 0.012 cu. ft. at 80 psi. Therefore, as an example, a 24,000# die set using approximately 20 feet of rail, would use $\frac{1}{4}$ cu. ft. of air to fill the system.

It is to be noted that the configuration of the die transfer system 10 is such that it is usable in all existing standard Joint Industrial Counsel T-slots, thereby to minimize installation cost.

While the preferred embodiment of the invention has been disclosed, it should be appreciated that the invention is susceptible of modification without departing from the scope of the following claims.

I claim:

1. The combination of a press having a bolster with a pair of standard Joint Industrial Counsel T-slots therein and a die transfer system, said die transfer system comprising a pair of elongated, horizontally extending vertically movable rails of inverted T-shaped cross section disposed in said T-slots, respectively, each of said rails having laterally extending flanges at the lower extremity thereof for engagement with a pair of complementary laterally extending shoulders at the upper ends of said T-slots, respectively, a plurality of rollers supported by each of said rails and movable vertically therewith, a pair of air bags extending longitudinally of each of said T-slots under said rails, respectively, and engageable with the bottoms thereof, inflation of said air bags effecting vertical movement of said rails and rollers in translation into engagement with the bottom of said die and elevation of said die relative to said bolster, the flanges on said rails being engageable with the shoulders on said T-slots to limit upward movement of said rails and distortion thereof.

* * * * *